US010710789B2

(12) United States Patent
Schur et al.

(10) Patent No.: US 10,710,789 B2
(45) Date of Patent: Jul. 14, 2020

(54) MULTI-CHAMBER BAG

(71) Applicant: Schur Star Systems, Inc., Carlsbad, CA (US)

(72) Inventors: Johan Schur, Oceanside, CA (US); Hans Christian Schur, Oceanside, CA (US)

(73) Assignee: Schur Star Systems, Inc., Carlsbad, CA (US)

( * ) Notice: Subject to any disclaimer, the term of this patent is extended or adjusted under 35 U.S.C. 154(b) by 0 days.

(21) Appl. No.: 16/052,398

(22) Filed: Aug. 1, 2018

(65) Prior Publication Data

US 2019/0039805 A1 Feb. 7, 2019

Related U.S. Application Data

(60) Provisional application No. 62/540,500, filed on Aug. 2, 2017.

(51) Int. Cl.

*B65D 81/32* (2006.01)
*B65D 81/34* (2006.01)
*B65D 33/25* (2006.01)

(52) U.S. Cl.

CPC ..... *B65D 81/3266* (2013.01); *B65D 33/2508* (2013.01); *B65D 81/3461* (2013.01); *B65D 2581/3427* (2013.01); *B65D 2581/3429* (2013.01)

(58) Field of Classification Search

CPC ..... B65D 81/3266; B65D 81/3461; B65D 2581/3427
USPC ..... 383/38–40, 100–103
See application file for complete search history.

(56) References Cited

U.S. PATENT DOCUMENTS 4,806,371 A * 2/1989 Mendenhall ..... B65D 81/3469 206/219
6,254,907 B1 7/2001 Galomb
2009/0117323 A1 5/2009 Lin
2009/0142006 A1 6/2009 Wine et al.
2009/0257685 A1* 10/2009 Matias ..... B65D 33/2566 383/38

(Continued)

FOREIGN PATENT DOCUMENTS

EP 1783059 A1 5/2007
GB 2449288 A * 11/2008 ..... B65B 29/08

(Continued)

OTHER PUBLICATIONS

Machine translation of JP-2012250724-A.*

(Continued)

*Primary Examiner* — Jes F Pascua
(74) *Attorney, Agent, or Firm* — Procopio, Cory, Hargreaves & Savitch LLP

(57) ABSTRACT

A storage bag including a film sheet is provided. The film sheet defines a first chamber, a second chamber located adjacent the first chamber; and a releasable seal preventing fluid communication between the first chamber and the second chamber. The releasable seal may be configured to release when an internal temperature within either the first chamber or the second chamber exceeds a temperature threshold or an internal pressure within either the first chamber or the second chamber exceeds a pressure threshold.

11 Claims, 8 Drawing Sheets

(56) References Cited

U.S. PATENT DOCUMENTS

| | | | | |
|---|---|---|---|---|
| 2009/0310890 | A1* | 12/2009 | Suzuki | A61J 1/2093 383/38 |
| 2010/0142862 | A1 | 6/2010 | Sam et al. | |
| 2010/0159083 | A1* | 6/2010 | Peplinski | B65D 81/3266 426/113 |
| 2013/0301957 | A1* | 11/2013 | Pellingra | B65D 81/3266 383/37 |
| 2014/0366484 | A1* | 12/2014 | Galbasini | B65D 81/3266 53/410 |

FOREIGN PATENT DOCUMENTS

| | | | | | |
|---|---|---|---|---|---|
| GB | 2546782 | A | * | 8/2017 | B65B 25/22 |
| JP | 2000185777 | A | * | 7/2000 | B65D 81/3461 |
| JP | 2012250724 | A | * | 12/2012 | |
| WO | WO-2016138591 | A1 | * | 9/2016 | B65D 81/343 |

OTHER PUBLICATIONS

Machine translation of JP-2000185777-A.*

International Search Report and Written Opinion for related PCT Application No. PCT/US2018/044833, dated Nov. 16, 2018, in 16 pages.

* cited by examiner

MULTI-CHAMBER BAG

CROSS REFERENCE TO RELATED APPLICATIONS

This application claims benefit to U.S. Provisional Application 62/540,500, filed Aug. 2, 2017, entitled "DUAL CHAMBER BAG," the contents of which are hereby incorporated by reference in their entirety.

BACKGROUND

Technical Field

This disclosure relates to a flexible container, such as a storage bag for food products and the like. More particularly, the present invention relates to a bag having a plurality of chambers separated by a releasable seal and vented for microwave cooking of sealed food products.

Related Art

Some storage bags can have a single compartment or chamber in which to store edible goods. Such storage bags can be used for transport and display of various food goods in, for example, a grocery store. However, such goods are only stored in such storage bags. In order to prepare or heat the subject food goods, they must be removed from the storage bags and prepared in a different container before they can be consumed.

SUMMARY

Aspects of the present application include a storage bag including a film sheet. The film sheet defines a first chamber, a second chamber located adjacent the first chamber; and a releasable seal preventing fluid communication between the first chamber and the second chamber. The releasable seal may be configured to release or release when an internal temperature within either the first chamber or the second chamber exceeds a temperature threshold or an internal pressure within either the first chamber or the second chamber exceeds a pressure threshold or upon a desired combination of temperature and pressure being exceeded.

An aspect of the disclosure provides a multi-chamber storage bag formed of a film sheet. The storage bag can have a first chamber. The storage bag can have a second chamber located adjacent the first chamber. The storage bag can have a releasable seal joining the first chamber and the second. The releasable seal can prevent fluid communication between the first chamber and the second chamber. The releasable seal can release in response to an internal temperature within the first chamber exceeds a temperature threshold. The releasable seal can release in response to an internal temperature within the second chamber exceeds the temperature threshold. The releasable seal can release in response to a temperature of the releasable seal exceeding a threshold. The releasable seal can release in response to an internal pressure within the first chamber exceeds a pressure threshold. The releasable seal can release in response to an internal pressure within the second chamber exceeds the pressure threshold.

Another aspect of the disclosure provides a storage bag. The storage bag can have an upper chamber formed from a first plurality of panels of a film sheet, and configured to contain a first edible food. The storage bag can have a lower chamber disposed adjacent the upper chamber and formed from a second plurality of panels of the film sheet. The second plurality of panels can have a plurality of apertures, the lower chamber being configured to contain a second edible food. The storage bag can have a releasable seal disposed between the upper chamber and the lower chamber. The releasable seal can prevent fluid communication between the upper chamber and the lower chamber when ambient pressure within the lower chamber is below a threshold. The releasable seal can release when a pressure within the lower chamber rises above a threshold.

Other features and advantages will be apparent to one of ordinary skill in the art with a review of the following detailed description.

BRIEF DESCRIPTION OF THE DRAWINGS

The details of embodiments of the present disclosure, both as to their structure and operation, can be gleaned in part by study of the accompanying drawings, in which like reference numerals refer to like parts, and in which.

DETAILED DESCRIPTION

Figure 1:
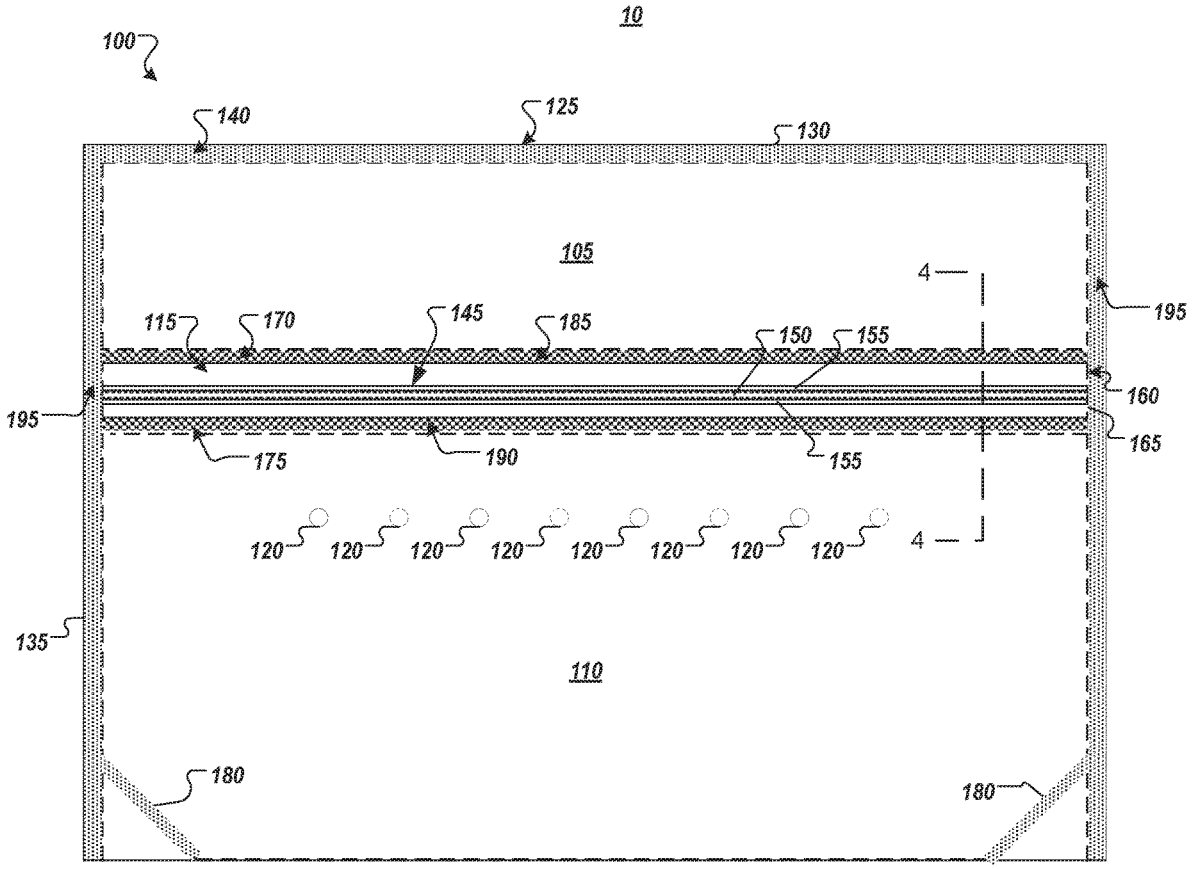
FIG. 1 is a graphical depiction of a front view of a storage bag according to an example implementation of the disclosed dual chamber bag.

Patent Body Reference throughout this specification to "one embodiment" or "an embodiment" means that a particular feature, structure, or characteristic described in connection with the embodiment is included in at least one embodiment. Thus, appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

The following detailed description provides further details of the figures and example implementations of the present application. Reference numerals and descriptions of redundant elements between figures are omitted for clarity. Terms used throughout the description are provided as examples and are not intended to be limiting. For example, the use of the term "automatic" may involve fully automatic or semi-automatic implementations involving user or operator control over certain aspects of the implementation, depending on the desired implementation of one of ordinary skill in the art practicing implementations of the present application.

FIG. 1 is a graphical depiction of a front view of an embodiment of a storage bag 100. The storage bag 100 can have a first chamber 105 and a second chamber 110. When stood upright, the second chamber 110 can be located vertically below the first chamber 105. Thus, as described herein, the first chamber 105 may be referred to as the upper chamber 105 and the second chamber 110 may be referred to as the lower chamber 110.

A releasable seal 115 can be located between the upper chamber 105 and the lower chamber 110. The releasable seal 115 may be configured to provide a fluid tight seal between the upper chamber 105 and the lower chamber 110 such that liquid or gas may not pass between the upper chamber 105 and the lower chamber 110 while the releasable seal 115 is closed. The upper chamber 105 and the lower chamber 110 can be formed from a single film sheet or from multiple segments of film sheets that are joined together as a single film sheet. These aspects are described below, in connection with FIG. 2 through FIG. 10. The terms "upper" and "lower" are not limiting on the scope of the disclosure.

In some example implementations, the releasable seal 115 may include a closure mechanism 145 formed by closure elements 150, 155 located on opposing seal member sheets 160, 165. In some other embodiments, the closure elements 150, 155 can be opposing or complementary sides of a seal to provide the fluid tight seal between the upper chamber 105 and the lower chamber 110. For example, the closure elements 150, 155 can form a complementary zipper-like attachment between each other, such as a press-and-lock zipper-style seal (see FIG. 4). As another example, the closure elements 150, 155 can be two opposing sides of the storage bag which are adhered to each other, for example using an adhesive (see FIG. 5). As another example, the closure elements 150, 155 can be opposing hook-and-loop style fasteners (see FIG. 6).

In some example implementations, the releasable seal 115 provided by the closure elements 150, 155 may be configured to release in response to an internal temperature and/or pressure within the upper chamber 105 and lower chamber 110 exceeding a threshold. An exemplary benefit of various embodiments of the releasable seal is the fluid tight seal is maintained until the edible contents of the lower chamber 110 are sufficiently cooked and the (steam) pressure within the lower chamber 110 has built to the point at which the releasable seal 115 is broken, providing fluid communication between the upper chamber 105 and the lower chamber 110. This feature is described in further detail in connection with FIG. 3 through FIG. 6, below. It is noted that the releasable seal 115 and the closure mechanism 145 of FIG. 1 resembles a zipper style seal, however the disclosure and the closure mechanism 145 are not so limited. Other example implementations of the releasable seal 115 are disclosed, for example, in connection with FIG. 3, FIG. 4, FIG. 5, and FIG. 6, below.

The storage bag 100 can include one or more ventilation openings 120. The ventilation openings 120 can be apertures or perforations providing fluid communication between an exterior atmosphere 10 surrounding the storage bag 100 and the lower chamber 110 to control pressure within the lower chamber 110. The ventilation openings 120 can ensure the releasable seal 115 does not release (e.g., separate, rupture, partially separate or partially rupture) prematurely and that the chamber does not release somewhere other than at the releasable seal. The number and size of the ventilation openings 120 may be selected such that during heating of the storage bag 100, the pressure within the lower chamber 110 increases at a particular rate such that edible goods in the upper chamber 105 and the lower chamber 110 are cooked or heated to a desired level prior to the releasable seal 115 rupturing. The rate of pressure change within the lower chamber 110 may be affected by the water/steam content of the edible goods in the upper chamber 105 and the lower chamber 110. For example, if the edible goods are potatoes, 8 ventilation openings having an average diameter of 1-1.5 mm may provide sufficient ventilation to control release of the releasable seal 115 until the potatoes are sufficiently cooked (approximately 6 minutes into heating). The number of the openings can vary, as can their size, in relation to the amount of edible goods. Alternatively, a one way or two way gas releasing valve may be used to control and release the pressure.

As illustrated in FIG. 2 through FIG. 10, the storage bag 100 may be formed from a plurality of sheets 125, 130, 135, 160, 165 of film material joined together by overlapping seals 140, 170, 175, 180 (represented by dotted patterns). The seals 140, 170, 175, 180 may be structured to avoid release even during heating of the bag, but may allow tearing or opening by a user after heating has been completed. In one example, the seals are formed by heat and pressure applied to overlapping portions of the sheets.

Figure 2:
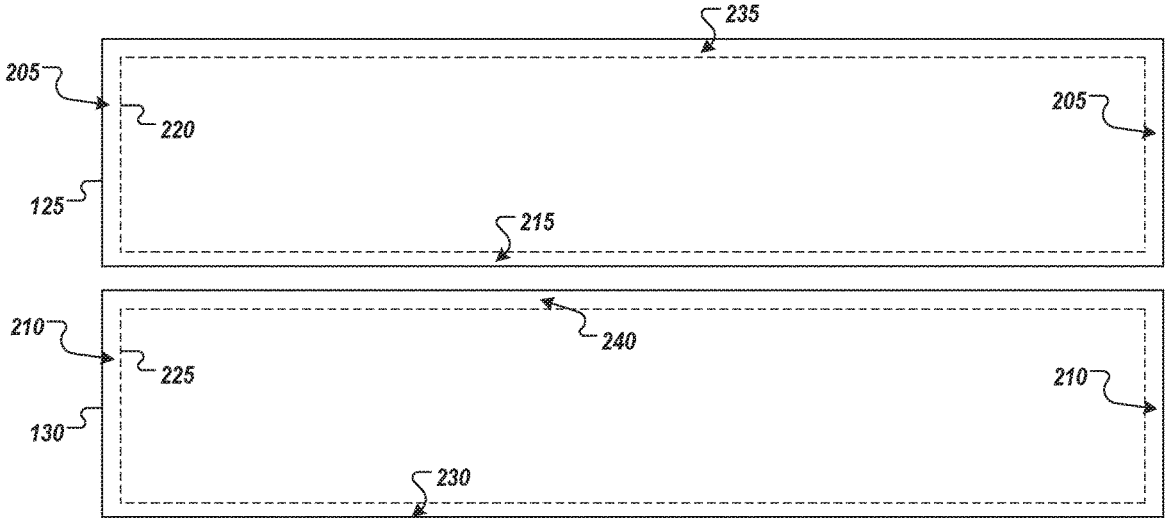
FIG. 2 is a graphical depiction of a pair of sheets 125, 130 that may form the upper chamber 105 of the storage bag 100 of FIG. 1.

FIG. 2 is a graphical depiction of a pair of sheets 125, 130 that may form the upper chamber 105 of the storage bag 100 of FIG. 1. In some example implementations, each sheet 125, 130 may be formed from a composite film material formed from a combination of 12 microns of polyester film and 100 microns of polypropylene. However, example implementations are not limited to these materials and other food safe/microwave safe films (such as orientated polypropylene film, polyamide film, etc.) may be apparent to a person of ordinary skill in the art. Additionally, a two-layer film may provide sufficient mechanical strength maintain to steam pressure during heating. However, other film constructions may be apparent to a person of ordinary skill in the art.

As illustrated, the sheet 125 includes vertical peripheral regions 205, a lower peripheral region 215 and an upper peripheral region 235 illustrated as the areas outside of the broken line box 220 of FIG. 2. Similarly, the sheet 130 includes vertical peripheral regions 210, a lower peripheral region 230 and a upper peripheral region 240 illustrated as the areas outside of the broken line box 225 of FIG. 2. The vertical peripheral regions 205 of sheet 125 may be bonded to the vertical regions 210 of the sheet 130 to form part of the vertical seal 195 (represented by a dotted pattern) along edges of the upper chamber 105 (FIG. 1). Further, the upper peripheral regions 235, 240 may be bonded together to form the upper seal 140 (represented by a dotted pattern) along the top edge of the upper chamber 105 (FIG. 1). Bonding may be achieved by heat sealing, adhesive application or any other bonding process that might be apparent to a person of ordinary skill in the art.

Figure 3:
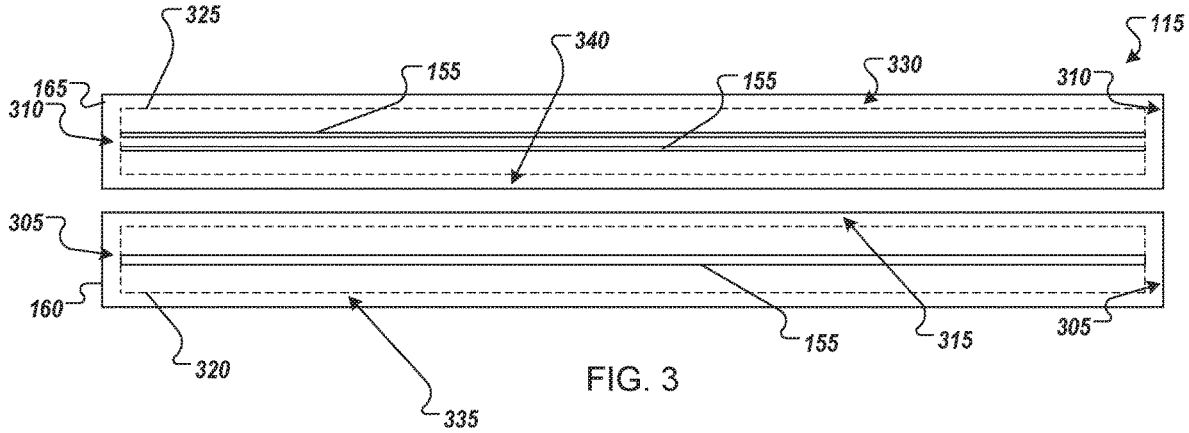
FIG. 3 is a graphical depiction of a pair of sheets 160, 165 that may form the releasable seal 115 of the storage bag 100 of FIG. 1.

FIG. 3 is a graphical depiction of a pair of sheets 160, 165 that may form the releasable seal 115 of the storage bag 100 of FIG. 1. In some example implementations, sheets 160, 165 may be formed from a composite film material formed from a combination of 12 microns of polyester film and 100 microns of polypropylene. However, example implementations are not limited to these materials and other food safe/microwave safe films (such as orientated polypropylene film, polyamide film, etc.) can be used. Additionally, a two-layer film may provide sufficient mechanical strength against steam pressure during heating. However, other film constructions may be apparent to a person of ordinary skill in the art.

The sheet 160 can have vertical peripheral regions 305, a lower peripheral region 335 and an upper peripheral region 315 illustrated as the areas outside of the broken line box 320 of FIG. 3. Additionally, the sheet 160 can have one or more closure elements 150 that extends from the surface thereof.

Similarly, the sheet 165 includes vertical peripheral regions 310, a lower peripheral region 340 and a upper peripheral region 330 illustrated as the areas outside of the broken line box 325 of FIG. 3. Additionally, the sheet 165 can have one or more closure elements 155 that extend from the surface thereof. The vertical peripheral regions 305 of sheet 160 may be bonded to the vertical regions 310 of the sheet 165 to form part of the vertical seal 195 (represented by a dotted pattern) along edges of the releasable seal 115 (FIG. 1). Bonding may be achieved by heat sealing, adhesive application or any other bonding process that might be apparent to a person of ordinary skill in the art.

Figure 4:
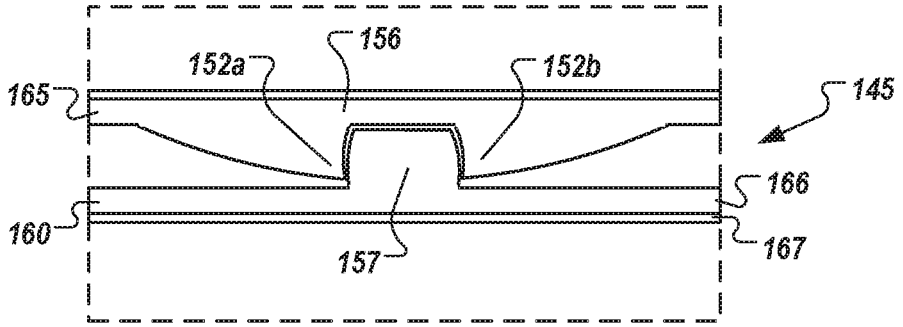
FIG. 4 is a cross section of an embodiment of the closure mechanism taken along the line 4-4 of FIG. 1.

FIG. 4 is a cross section of an embodiment of the closure mechanism taken along the line 4-4 of FIG. 1. In some embodiments, the closure mechanism 145 can be formed as a press-and-lock zipper seal. For example, the opposing seal member sheets 160, 165 can have one or more complementary interlocking features implemented as the closure elements 150, 155 of FIG. 3. For example, the closure elements 150, 155 can be implemented as a closure element 156 and a closure element 157 as shown in FIG. 4. In one embodiment, the sheet 165 can have closure element 156. The closure element 156 can have multiple closure element tabs 152*a*, 152*b*. In a complementary fashion, the opposing sheet 160 can have at least one closure element 157. The closure element 157 can be pressed in between the closure elements 152, for example, in an interference fit. Such an interference fit can provide the releasable seal 115 as described above. The shape of the closure elements 156, 157 of FIG. 4 are provided for illustrative purposes. Other profiles and numbers of closure elements 156, 157 may be present to provide the releasable seal 115.

In some examples, the closure elements 156, 157 may be formed from a material having a specific rigidity below the threshold temperature but may become sufficiently elastic above the threshold temperature such that the releasable seal may release in response to internal pressure (e.g., within the lower chamber 110) to allow fluid communication between the upper chamber 105 and the lower chamber 110.

Though the releasable seal 115 and the closure mechanism 145 is illustrated similar to a zipper in FIG. 1 and FIG. 3, example implementations of the releasable seal 115 are not limited to a press-and-lock zipper mechanism. In alternative implementations, the releasable seal 115 may be formed by other sealing structures such as those shown in FIG. 5, and FIG. 6. For example, adhesive regions (FIG. 5), hook and loop regions (FIG. 6), or any other releasable sealing structure that might be apparent to a person of ordinary skill in the art may be substituted for the closure mechanism 145 in example implementations.

Figure 5:
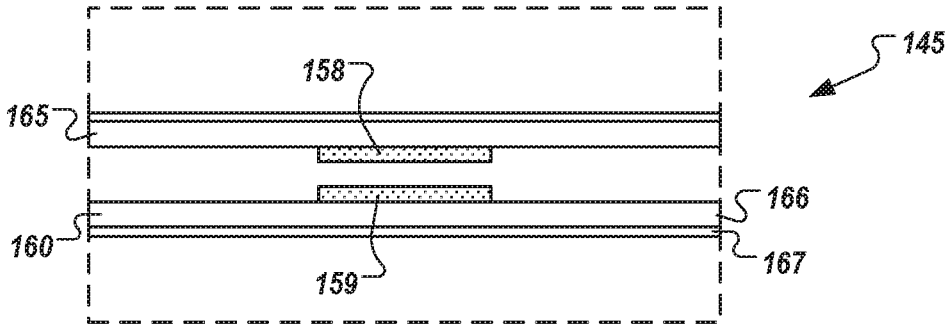
FIG. 5 is a cross section of another embodiment of the closure mechanism taken along the line 4-4 of FIG. 1.

FIG. 5 is a cross section of another embodiment of the closure mechanism taken along the line 4-4 of FIG. 1. In some embodiments, the closure mechanism 145 (e.g., the closure elements 150, 155) can be implemented as an adhesive seal. For example, the closure mechanism 145 can be implemented using a first adhesive 158 on a sealing location of the inner surface of the storage bag 100. In some embodiments and a second adhesive 159, opposite the first adhesive can also be used. The opposing seal member sheets 160, 165 and the corresponding first adhesive 158 and second adhesive 159 are shown separated from one another for illustrative purposes. In some embodiments, one or both of the first adhesive 158 and the second adhesive 159 can be an amount of adhesive, or an adhesive strip along the length of one or both of the opposing sheets 160, 165. Thus, the first adhesive 158 and the second surface 159 of the closure mechanism 145 can be structured to bond with sufficient strength to maintain the releasable seal 115 at pressures below the threshold, but release in response to the internal pressure exceeding the threshold. The threshold temperature and/or pressure selected may be within the upper chamber 105 and/or the lower chamber 110. In some embodiments, the first adhesive 158 and the second surface 159 of the closure mechanism 145 can be structured to soften at elevated temperatures and release the releasable seal 115 at a desired time and temperature. Thus, as a temperature of the releasable seal 115 exceeds a threshold, one of the first adhesive 158 and the second surface 159 of the closure mechanism 145 can soften and release.

Similar to the rigidity of the zipper-type closure mechanism of FIG. 4, the adhesive material can be selected to respond in the same manner described above to release at the appropriate time and/or in response to determined or selected pressure and temperature levels.

Figure 6:
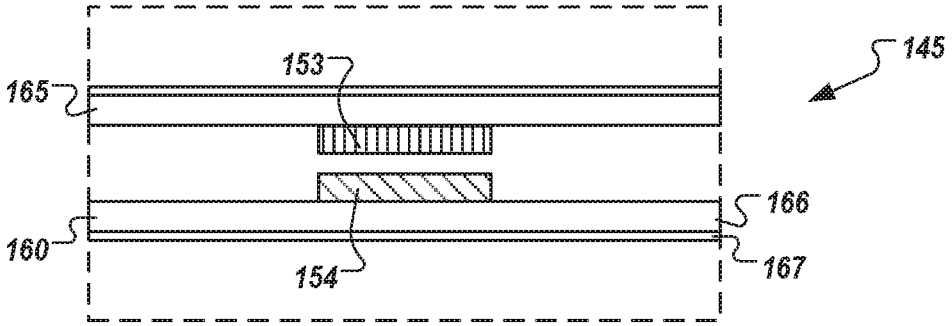
FIG. 6 is a cross section of another embodiment of the closure mechanism taken along the line 4-4 of FIG. 1.

FIG. 6 is a cross section of another embodiment of the closure mechanism taken along the line 4-4 of FIG. 1. In some embodiments, the closure mechanism 145 (e.g., the closure elements 150, 155) can be implemented as a hook-and-loop style closure. In some embodiments, the sheet 165 can have a loop strip 153 (illustrated as vertical stripes). The sheet 160 can then have a hook strip 154 (illustrated as diagonal stripes), complementary to the loop strip 153. The loop strip 153 can contact the hook strip 154 can create the releasable seal 115. The opposing seal member sheets 160, 165 and corresponding loop strip 153 and hook strip 154 are shown separated from one another for illustrative purposes.

Further, the releasable seal 115 provided by the closure mechanism 145 as shown in the embodiments of FIG. 4, FIG. 5, and FIG. 6 may be configured to release in response to a combination of an internal temperature and internal pressure within the upper chamber 105 and lower chamber 110 exceeding a threshold. For example, the ability of the releasable seal 115 to withstand internal pressure of the lower chamber 110 decreases as the temperature increases. Therefore, a tradeoff can be made between the temperature and the pressure at which the releasable seal 115 will release.

Figure 7:
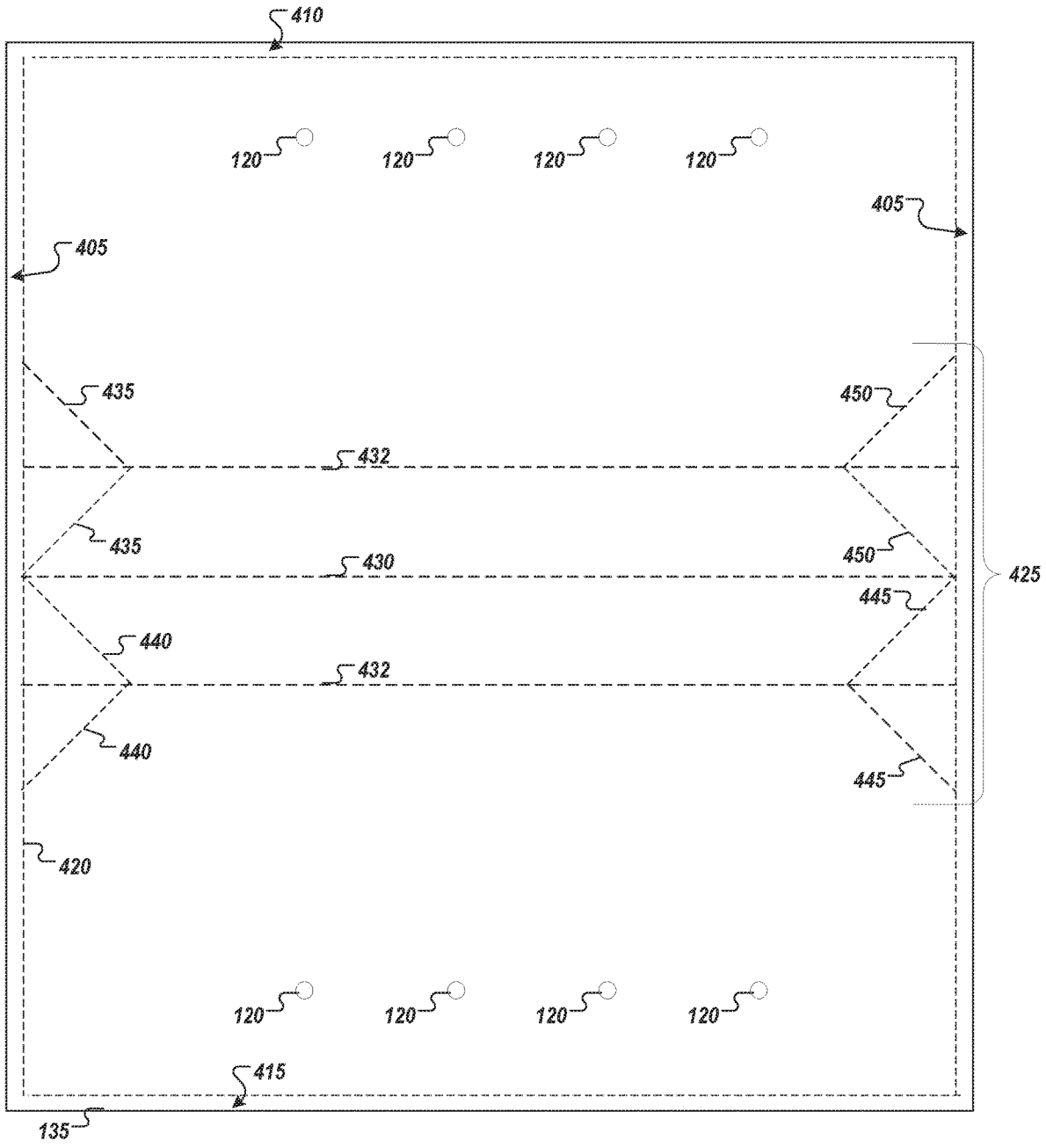
FIG. 7 is a graphical representation of sheet 135 that forms the lower chamber 110 of the storage bag 100 of FIG. 1.

FIG. 7 is a graphical representation of sheet 135 that forms the lower chamber 110 of the storage bag 100 of FIG. 1. In some example implementations, the sheet 135 may be formed from a composite film material formed from a combination of at least a first layer 166 and a second layer 167 of material as shown in FIG. 4, FIG. 5, and FIG. 6. In one example, 12 microns of polyester film and 100 microns of polypropylene. However, example implementations are not limited to these materials and other food safe/microwave safe films (such as orientated polypropylene film, polyamide film, etc.) may be apparent to a person of ordinary skill in the art. Additionally, a two-layer film may provide sufficient mechanical strength maintain to steam pressure during heating. In some embodiments, the sheet 135 can have one or more layers. In such a construction, the inner-most layer forming the layer that lines the interior of the upper chamber 105 and the lower chamber 110, can be a material joinable using heat or ultrasonic signals (e.g., weldable) such as polypropylene (PP), polyethylene (PE), or polyphenylene ether (PPE) plastic, for example. However, other film constructions may be apparent to a person of ordinary skill in the art. The thickness of the various layers of the material in the sheet 135 can be based on application and demand for strength. The bag 100 designed to contain 50 pounds of potatoes may require a more robust structure than 12 ounces of Brussels sprouts.

As illustrated, the sheet 135 includes vertical peripheral regions 405, a first horizontal peripheral region 410 and a second horizontal peripheral region 415 illustrated as the areas outside of the broken line box 420 of FIG. 7. The sheet 135 may also include a plurality of ventilation openings 120. The ventilation openings 120 can be arranged in one or more rows spaced apart. Additionally, the sheet 135 also includes a gusset region 425 that may be disposed between the rows of ventilation openings 120.

The number and size of the ventilation openings 120 may be selected such that during heating of the storage bag 100, the pressure within the lower chamber 110 increases at a particular rate such that edible goods in the upper chamber 105 and the lower chamber 110 is substantially cooked prior to the releasable seal 115 rupturing. The rate of pressure change within the lower chamber 110 may be affected by the water/steam content of the edible goods in the upper chamber 105 and the lower chamber 110. For example, if the edible goods are potatoes, eight (8) ventilation openings having an average diameter of 1-1.5 mm may provide sufficient ventilation to control release of the releasable seal 115 until the potatoes are sufficiently cooked (approximately 6 minutes into heating).

The gusset region 425 includes a plurality of folds spanning a width of the sheet 135, across the sheet 135. The folds are represented by broken lines (folds) 430, 432. The folds 430, 432 can be formed in a direction parallel to the one or more ventilation openings 120. The gusset region 425 can also have a plurality of seams represented by broken lines 435, 440, 445, 450 adjacent the folds represented by broken lines 432. The seams can be formed by sealing or otherwise welding adjacent pairs of the broken lines 435, 440, 445, 450 together. The resulting seams can then lie at either end (first end opposite a second end) of the folds 430, 432.

When the bag 100 is assembled, the gusset region 425 is folded along each of the broken lines 430, 432. Specifically, the gusset region 425 is folded in a first direction along broken line 430 and folded in a second, different direct along broken line 432. The first direction can be parallel to the first horizontal peripheral region 410 and the second peripheral region 415. The second direction can be at an angle to the first direction as shown in FIG. 7. In some examples the folds 430, 432 (first direction) can lie at approximately a 45 degree angle to the seams between adjacent pairs of the broken lines 435, 440, 445, 450, when assembled. Additionally, each of the seams represented by broken lines 435 may be bonded together. Further, each of the seams represented by broken lines 440 may be bonded together. Additionally, each of the seams represented by broken lines 445 may be bonded together. Each of the seams represented by broken lines 450 may also be bonded together. Additionally, once folded along the broken lines 430, the vertical peripheral region 405 of each side of the sheet 135 may be bonded to itself to form part of the vertical seal 195 (represented by a dotted pattern) along edges of the lower chamber 110 in FIG. 1. Once folded and bonded, the gusset region 425 may allow the bag 100 to free stand. Bonding may be achieved by heat sealing, adhesive application or any other bonding or welding process that might be apparent to a person of ordinary skill in the art.

Figure 8:
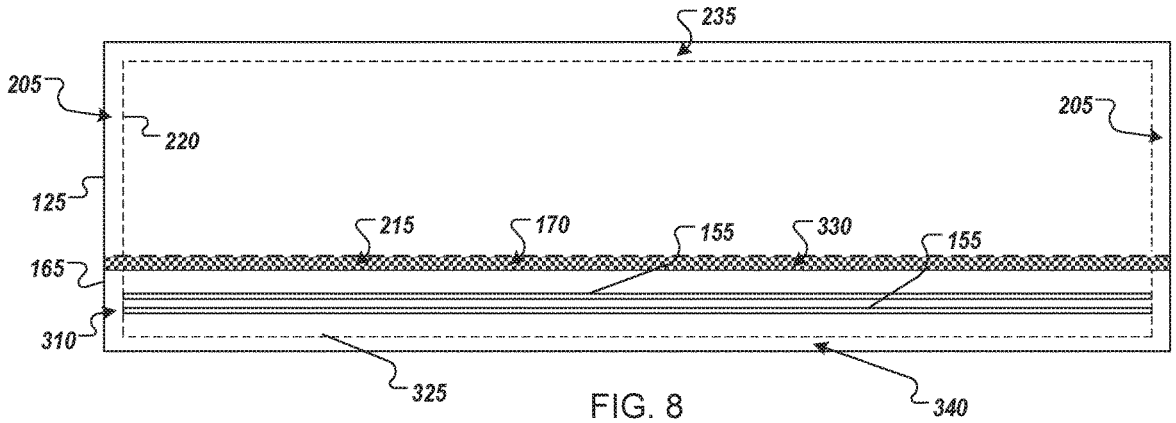
FIG. 8 is a graphical depiction of the sheet 125 of FIG. 1.

FIG. 8 is a graphical depiction of the sheet 125 of FIG. 1. The sheet 125 can form a portion (e.g., half) of the upper chamber 105 of the storage bag 100 (FIG. 1) when bonded to the sheet 130 and the sheets 165 that forms the releasable seal 115.

Figure 9:
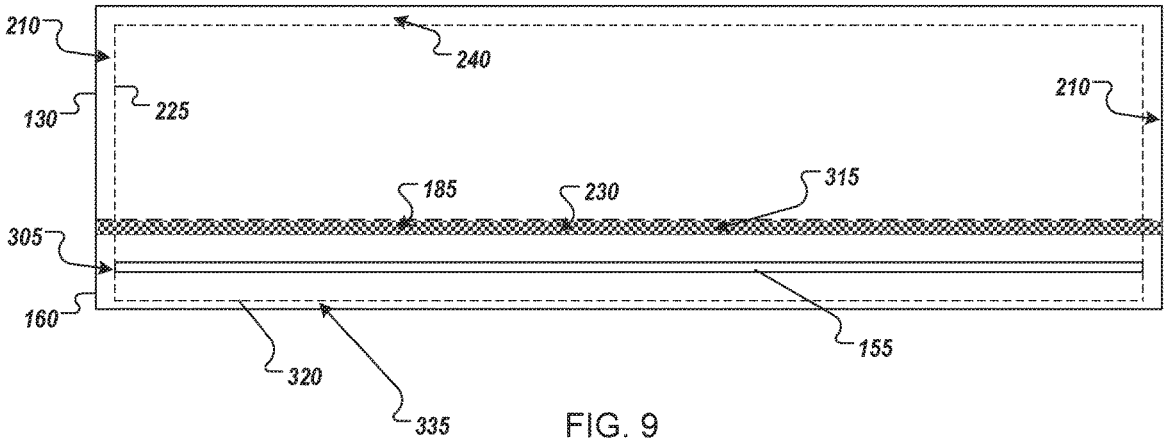
FIG. 9 is a graphical depiction of the sheet 130 of FIG. 1.

FIG. 9 is a graphical depiction of the sheet 130 of FIG. 1. The sheet 130 can form a portion of the upper chamber 105 when bonded to the sheet 125 and the sheets 160 that forms the releasable seal 115. The upper chamber 105 is then completely formed when the sheets 125, 130 are bonded to one of the sheets 160, 165 that form the releasable seal 115 in accordance with example implementations of the present application.

As shown in FIG. 8, the upper peripheral region 330 of sheet 165 has been bonded to the lower peripheral region 215 of sheet 125 to form a seal 170 (represented by a dotted pattern). Similarly, as shown in FIG. 9, the upper peripheral region 315 of sheet 160 has been bonded to the lower peripheral region 230 to form a seal 185 (represented by a dotted pattern). Bonding may be achieved by heat sealing, adhesive application or any other bonding process that might be apparent to a person of ordinary skill in the art.

Figure 10:
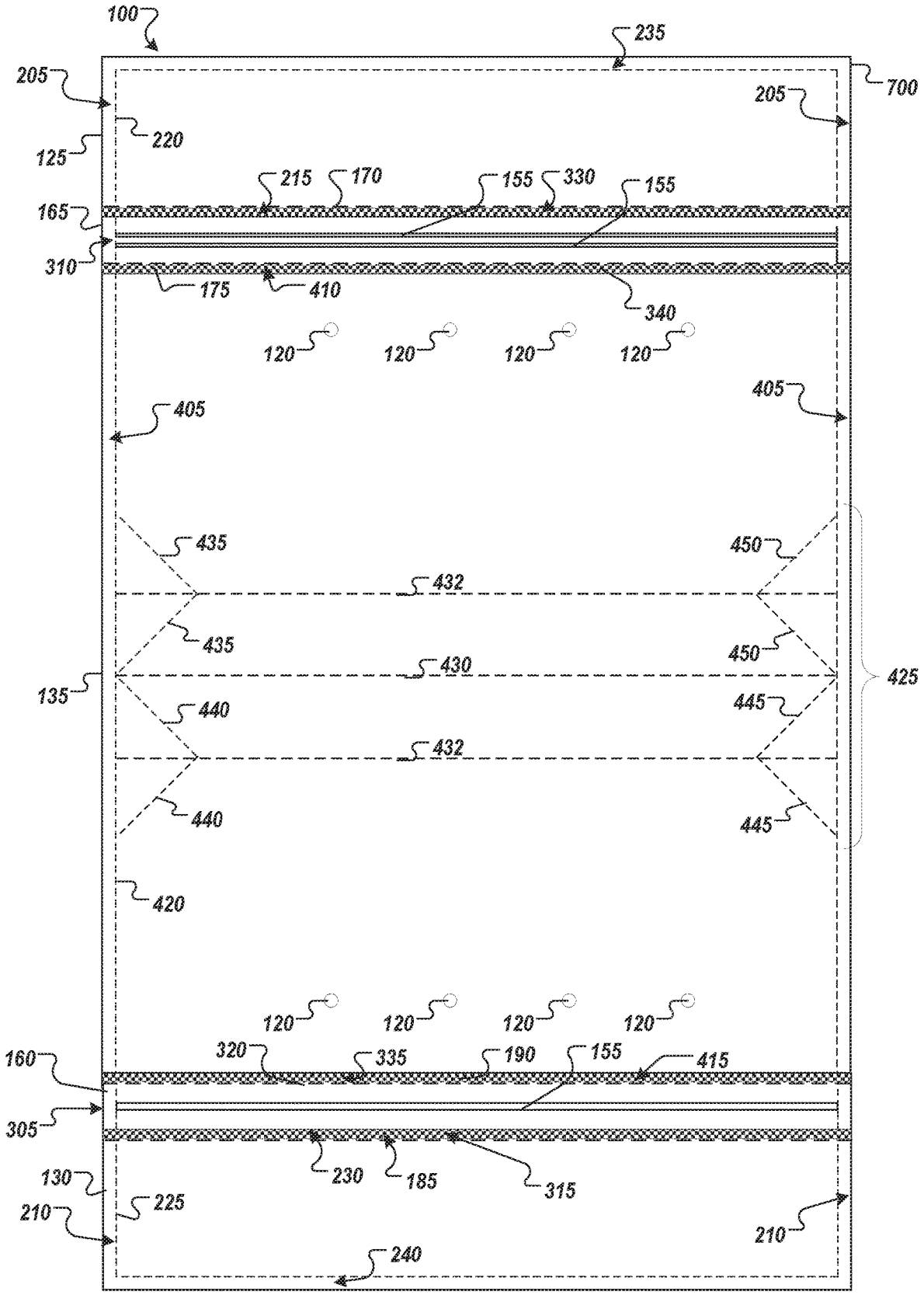
FIG. 10 is a graphical representation of another embodiment of the bag of FIG. 1.

FIG. 10 is a graphical representation of another embodiment of the bag of FIG. 1. In some embodiments, the bag 100 (FIG. 1) can be formed from a single sheet 700 of film material. The film material can also be referred to herein as a film sheet, comprising the single sheet 700. In this embodiment, the sheets 125, 130, 135 described above in connection with FIG. 2 through FIG. 9 may be replaced by analogous regions or sections 125, 130, 135 of the single sheet 700. For ease of description, identical reference numbers have been used to refer to analogous aspects of the sheets 125, 130, 135 of the single sheet 700. As illustrated, the upper first horizontal peripheral region 410 of the sheet 135 is integral with (or has been bonded to) the lower peripheral region of sheet 165 forms part of the releasable seal 115, to form the seal 175 (represented by a dotted pattern). The upper peripheral region 330 of sheet 165 that forms part of the releasable seal 115 is integral with (or has been bonded to) a lower peripheral region 215 of sheet 125 that forms part of the upper chamber 105 to form a seal 170 (represented by a dotted pattern).

Further, the sheet 160 that forms part of the releasable seal 115 in FIG. 1 may be rotated 180° such that the lower or second peripheral region 415 of sheet 135 may be bonded to the lower peripheral region 335 of sheet 160 to form a seal 190 (represented by a dotted pattern). The upper peripheral region 315 of sheet 160 of the releasable seal 115 (FIG. 1) is integral with (or is bonded to) a lower peripheral 230 of sheet 130 that forms part of the upper chamber 105 to form a seal 185 (represented by a dotted pattern).

Additionally, the vertical peripheral regions 205 of sheet 125 may be integral with (or bonded to) the vertical regions 210 of sheet 130 to form part of the vertical seal 195 (represented by a dotted pattern of FIG. 1) along edges of the upper chamber 105. Further, the vertical peripheral regions 305 of sheet 160 may be bonded to the vertical regions 310 of sheet 165 to form part of the vertical seal 195 (represented by a dotted pattern) along edges of the releasable seal 115 in FIG. 1.

The gusset region 425 includes a plurality of folds represented by broken lines 430, 432 and a plurality of seams represented by broken lines 435, 440, 445, 450 adjacent the folds represented by broken lines 432. When the bag 100 is assembled, the gusset region 425 is folded along each of the broken lines 430, 432. Specifically, the gusset region 425 is folded in a first direction along broken line 430 and folded in a second, different (e.g., opposite) direction along broken line 432. Additionally, each of the seams represented by broken lines 435 may be bonded together. Further, each of the seams represented by broken lines 440 may be bonded together. Additionally, each of the seams represented by broken lines 445 may be bonded together. Each of the seams represented by broken lines 450 may also be bonded together. Additionally, once folded along the broken lines 430, the vertical peripheral region 405 of each side of the sheet 135 may be bonded to itself to form part of the vertical seal 195 (represented by a dotted pattern) along edges of the lower chamber 110 in FIG. 1. Once folded and bonded, the gusset region 425 may allow the bag 100 to free stand. Bonding may be achieved by heat sealing, adhesive application or any other bonding process that might be apparent to a person of ordinary skill in the art.

Additionally, once folded along the broken lines 430, the vertical peripheral region 405 of each side of the sheet section may be bonded to itself to form part of the vertical seal 195 (represented by a dotted pattern) along edges of the lower chamber 110 in FIG. 1. Once folded and bonded, the gusset region 425 may allow the bag 100 to free stand. Additionally, the upper peripheral regions 235, 240 of sheets 205, 210 may be bonded together to form the upper seal 140 (represented by a dotted pattern) along the top edge of the upper chamber 105 in FIG. 1. Bonding may be achieved by heat sealing, adhesive application or any other bonding process that might be apparent to a person of ordinary skill in the art.

Though FIG. 2 through FIG. 9 illustrate the bag 100 being formed from five individual sheets 125, 130, 135, 160, 165 of film bonded together, example implementations are not limited to this configuration. For example, the bag 100 can be formed from a single sheet of film, as described above in connection with FIG. 10.

Other implementations may be formed from any number of sheets that might be apparent to a person of ordinary skill in the art. Additionally, though FIG. 8 and FIG. 9 illustrate the sheets 160, 165 that form the releasable seal 115 first being bonded to the sheets 125, 130 that form the upper chamber 105, and then bonded to the sheet 135 that forms the lower chamber 110, example implementations are not limited to this configuration. Other example implementations may be formed by first bonding the sheets 160, 165 to the sheet 135, or any other arrangement that might be apparent to a person of ordinary skill in the art.

Figure 11:
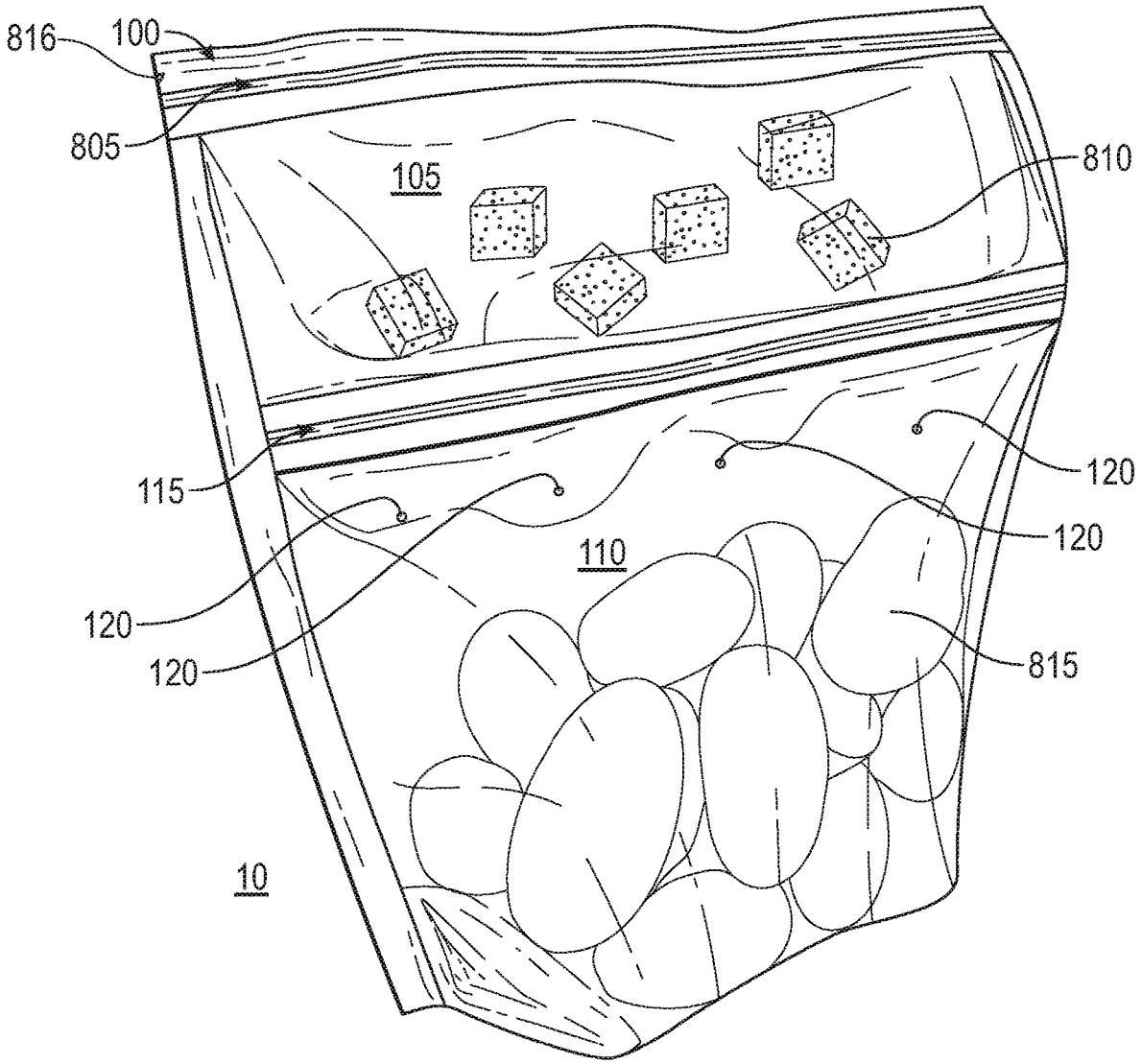
FIG. 11 is a perspective view of a bag 100 of FIG. 1.

FIG. 11 is a perspective view of a bag 100 of FIG. 1. The bag 100 can be used with various types of edible goods 815, 820 provided in the upper chamber 105 and in the lower chamber 110. As illustrated, a first type of edible goods 810 (e.g., butter, margarine, salt, pepper, garlic, spices, etc., alone or in combination) are provided in the upper chamber 105. A second type of edible goods 815 (e.g., potatoes) may be provided in the lower chamber 110. The releasable seal 115 may keep the first type of edible goods 810 separate from the second type of edible goods 815 for transport, storage, etc. A plurality of ventilation openings 120 are provided in the bag 100 to allow fluid communication between the interior of the lower chamber 110 and the atmosphere 10 surrounding the bag. Additionally, in some embodiments, the upper edge 805 of the bag 100 may be a tear away portion to allow the bag 100 to be opened. For example, a notch 816 may be present enabling the upper edge 805 of the upper chamber 105 to be torn away. In some embodiments the bag 100 can have one or more notches 816.

The bag 100 may be heated (e.g., using a microwave oven or other heating source). As bag 100 is heated, each of the first type of edible goods 810 and the second type of edible goods 815 are separately heated in their respective upper chamber 105 and lower chamber 110. In some embodiments, as each of the first type of edible goods 810 and the second type of edible goods 815 are heated, steam or other gaseous food material may build up in the upper chamber 105 and the lower chamber 110, increasing internal pressure within. As the internal pressure increases in the upper chamber 105 and the lower chamber 110, the stress created by the increased pressure may be applied to releasable seal 115. When the pressures within the upper chamber 105 and the lower chamber 110 exceed a threshold, the releasable seal 115 will release and gravity may pull the first type of edible goods 810 toward the second type of edible goods 815 mixing the two types of edible goods 810, 815.

Alternatively, the releasable seal 115 may be configured to release in response to an internal temperature within the upper chamber 105 and lower chamber 110 exceeding a threshold. For example, releasable seal 115 may be formed from a material having a specific rigidity below the threshold temperature but may become sufficiently elastic above the threshold temperature. The elasticity can be such that the releasable seal releases or opens in response to internal pressure to allow fluid communication between the upper chamber 105 and the lower chamber 110. This can allow the first type of edible goods 810 to mix with the second type of edible goods 815

Further, in some example implementations, the releasable seal 115 may be configured to release in response to a combination of an internal temperature and internal pressure within the upper chamber 105 and lower chamber 110 exceeding a threshold. For example, the releasable seal 115 may be formed from a material having a rigidity that decreases in response increasing temperature. As the rigidity decreases (the material becomes more elastic) the adhesion of the seal decreases. The ability of the seal to withstand internal pressure decreases as the temperature increases. Therefore, a tradeoff can be made between the temperature and the pressure at which the releasable seal will release.

The openings 120 providing fluid communication between the exterior atmosphere 10 surrounding the storage bag 100 and the lower chamber 110 allow control of the pressure within the lower chamber 110 to ensure the releasable seal 115 does not release prematurely (e.g., before the first type of edible goods 810 and the second type of edible goods 815 are sufficiently cooked). The openings 120 can further ensure that the lower chamber 110 does not release somewhere other than at the releasable seal. The number and size of the ventilation openings 120 may be selected such that during heating of the storage bag 100, the pressure within the lower chamber 110 increases at a particular rate such that edible goods in the upper chamber 105 and the lower chamber 110 are substantially cooked prior to the releasable seal 115 rupturing. For example, for the second type of edible goods 815 being potatoes, eight (8) ventilation openings having an average diameter of 1-1.5 mm may provide sufficient ventilation to control release of the releasable seal 115 until the potatoes are sufficiently cooked (approximately 6 minutes). The number of the openings can vary, as can their size, in relation to the amount of edible goods.

Figure 12:
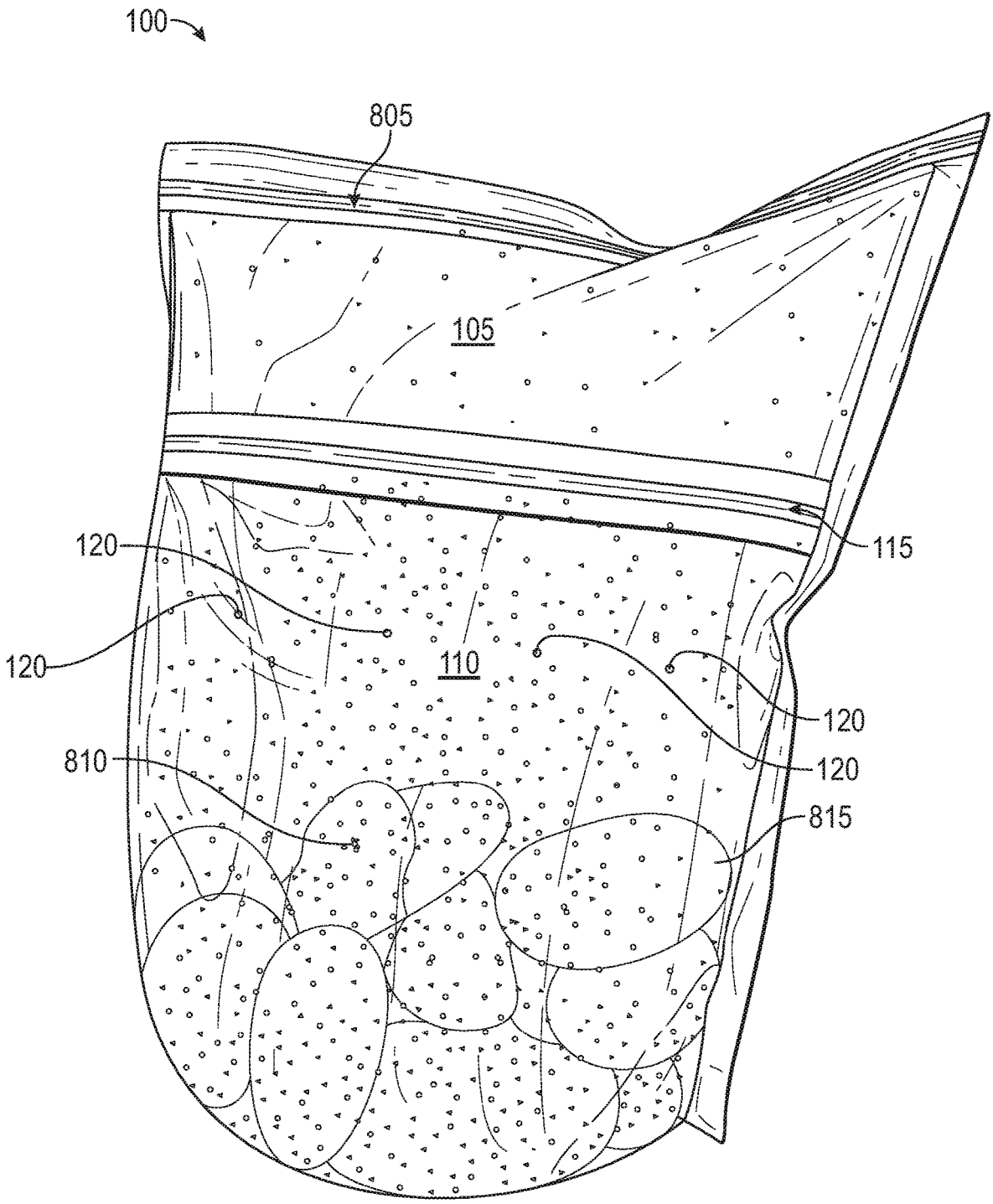
FIG. 12 is another perspective view of the bag of FIG. 1.

FIG. 12 is another perspective view of the bag of FIG. 1. The bag 100 is shown with the first type of edible goods 810 and the second type of edible goods 815 after heating. As illustrated, releasable seal 115 has released and the first type of edible goods 810 (e.g., butter, margarine, salt, pepper, garlic, spices, etc., alone or in combination) has mixed or coated the second type of edible goods 815 (e.g., potatoes) in the lower chamber 110. The bag 100 is shown inflated due to, for example, the release of steam and other vapors from the cooked second type of edible goods 815. The first type of edible goods 810 is shown dispersed about the second type of edible goods 815 and is depicted as scattered circles and triangles representing, for example, spices or other seasonings.

In some embodiments, pressure may increase in only one of the upper chamber 105 and the lower chamber 110. For example, in the example, of FIG. 12, if the first type of edible foods 810 is a seasoning, it may not produce an appreciable amount of steam or other gaseous food when heated. Therefore, the increased pressure that releases the releasable seal 115 may originate in (predominantly) the lower chamber 110, as for example, the second edible goods 815 produces steam as it cooks.

Alternatively, the releasable seal 115 may be configured to release in response to an internal temperature within the upper chamber 105 and lower chamber 110 exceeding a threshold. For example, releasable seal 115 may be formed from a material having a specific rigidity below the threshold temperature but may become sufficiently elastic above the threshold temperature such that the releasable seal may release in response to internal pressure to allow fluid communication between the upper chamber 105 and the lower chamber 110.

Further, in some example implementations, the releasable seal 115 may be configured to release in response to a combination of an internal temperature and internal pressure within the upper chamber 105 and lower chamber 110 exceeding a threshold. For example, the releasable seal 115 may be formed from a material having a rigidity that decreases in response increasing temperature. As the rigidity decreases (the material becomes more elastic) the adhesion of the seal decreases. The ability of the seal to withstand internal pressure decreases as the temperature increases. Therefore, a tradeoff can be made between the temperature and the pressure at which the releasable seal will release.

The bag 100 may now be opened and the combination of the first type of edible goods 810 and the second type of edible goods 815 may be consumed. For example, the upper edge 805 of the bag 100 may be torn away to allow the bag 100 to be opened. Other mechanisms for opening the bag 100 may be apparent to a person of ordinary skill in the art.

Though potatoes are illustrated as the second type of edible goods 815 in FIG. 8 and FIG. 9, example implementations are not limited to these edible goods and other edible goods may be apparent to a person of ordinary skill in the art.

The foregoing detailed description has set forth various embodiments of the devices and/or processes via the use of block diagrams, schematics, and examples. Insofar as such block diagrams, schematics, and examples contain one or more functions and/or operations, each function and/or operation within such block diagrams, schematics, or examples can be implemented, individually and/or collectively.

While certain embodiments have been described, these embodiments have been presented by way of example only, and are not intended to limit the scope of the protection. Indeed, the novel methods and apparatuses described herein may be embodied in a variety of other forms. Furthermore, various omissions, substitutions and changes in the form of the methods and systems described herein may be made without departing from the spirit of the protection. The accompanying implementations and their equivalents are intended to cover such forms or modifications as would fall within the scope and spirit of the protection.

Although the present disclosure provides certain example embodiments and applications, other embodiments that are apparent to those of ordinary skill in the art, including embodiments which do not provide all of the features and advantages set forth herein, are also within the scope of this disclosure. Accordingly, the scope of the present disclosure is intended to be defined only by reference to the appended claims.

What is claimed is:

1. A multi-chamber storage bag, the storage bag comprising:

a first chamber containing a first edible food and comprising a first pair of sheets defining the first chamber, each of the first pair of sheets has a first end and a second end opposite the first end;

a second chamber located adjacent the first chamber containing a second edible food, and comprising a folded sheet defining the second chamber, the folded sheet having a first end and a second end and; and a releasable seal joining the first chamber and the second chamber, and preventing fluid communication between the first chamber and the second chamber and the resealable seal comprising a second pair of sheets, each of the second pair of sheets being bonded to one of the first pair of sheets, the first end of the folded sheet bonded to one of the second pair of sheets opposite to one of the first pair of sheets, the second end of the folded sheet bonded to another of the second pair of sheets opposite another of the first pair of sheets, and each of the second pair of sheets releasably sealed to the other of the second pair of sheets, the releasable seal being configured to release in response to one or more of:

an internal temperature within the first chamber exceeds a temperature threshold, an internal temperature within the second chamber exceeds the temperature threshold, a temperature of the releasable seal exceeds a threshold, an internal pressure within the first chamber exceeds a pressure threshold, and an internal pressure within the second chamber exceeds the pressure threshold.

2. The multi-chamber storage bag of claim 1, further comprising:

at least one ventilation opening formed through the folded sheet, and allowing fluid communication between an interior of the second chamber and an atmosphere surrounding the multi-chamber storage bag, the at least one ventilation opening having a diameter selected to control a rate of change of pressure within the second chamber when heat is applied to the multi-chamber storage bag.

3. The multi-chamber storage bag of claim 2, wherein the at least one ventilation opening comprises a plurality of ventilation openings, and a number of the plurality of ventilation openings is selected to control a rate of change of pressure within the second chamber when heat is applied to the multi-chamber storage bag.

4. The multi-chamber storage bag of claim 3, wherein the plurality of ventilation openings comprises eight ventilation openings.

5. The multi-chamber storage bag of claim 2, wherein the at least one ventilation opening has a diameter less than or equal to 1.5 mm and greater than or equal to 1.0 mm.

6. The multi-chamber storage bag of claim 2, wherein the second chamber comprises a gusset region having:

a plurality of folds spanning a width of the lower chamber, each fold of the plurality of folds having a first end and a second end opposite the first end;

a first plurality of seams adjacent the first end; and a second plurality of seams adjacent the second end, the first plurality of seams and the second plurality of seams lying at an angle to the plurality of folds.

7. The multi-chamber storage bag of claim 2 wherein the first end of one of the first pair of sheets being bonded to the first end of the other of the first pair of sheets opposite the releasable seal.

8. The multi-chamber storage bag of claim 1, wherein the releasable seal comprises one of:

a zipper mechanism;

an adhesive; and a hook-and-loop fastener.

9. The multi-chamber storage bag of claim 1, wherein each of the first pair of sheets comprises two layers and the first layer of the two layers is 12 microns thick and the second layer of the two layers is 100 microns thick.

10. The multi-chamber storage bag of claim 1, wherein the folded sheet further comprises a gusset region opposite the releasable seal, the gusset region comprising:

a first fold in a first direction; and a pair of second folds in a second direction different than the first direction.

11. The multi-chamber storage bag of claim 10, wherein the gusset region further comprises:

a first set of seams adjacent one of the pair of second folds, the first set of seams being bonded together;

a second set of seams adjacent the one of the pair of second folds, the second set of seams being bonded together;

a first set of seams adjacent another of the pair of second folds, the first set of seams being bonded together; and a second set of seams adjacent the other of the pair of second folds, the second set of seams being bonded together.

* * * * *